United States Patent [19]

Gill

[11] 4,182,516

[45] Jan. 8, 1980

[54] SAILBOAT RACING GAME

[76] Inventor: Douglas C. Gill, 1191 Newton Rd., Oakville, Ontario, L6H 2A1, Canada

[21] Appl. No.: 903,532

[22] Filed: May 8, 1978

[51] Int. Cl.[2] ..... A63F 3/00; A63F 9/00

[52] U.S. Cl. ..... 273/258; 273/289; 273/259; 273/282

[58] Field of Search ..... 273/258, 259, 246, 244, 273/271, 288, 289, 290, 282

[56] References Cited

U.S. PATENT DOCUMENTS

| | | | |
|---|---|---|---|
| 1,366,181 | 1/1921 | Hodgson | 273/288 X |
| 1,533,540 | 4/1925 | Craigen | 273/186 B |
| 2,053,598 | 9/1936 | Blau | 273/265 |
| 3,820,791 | 6/1974 | Powers | 273/258 |
| 3,871,656 | 3/1975 | Selness | 273/258 |

FOREIGN PATENT DOCUMENTS

| | | | |
|---|---|---|---|
| 495506 | 8/1953 | Canada | 273/258 |
| 2408344 | 8/1975 | Fed. Rep. of Germany | 273/288 |
| 1217280 | 5/1960 | France | 273/246 |
| 2229202 | 12/1974 | France | 273/288 |
| 7202 | of 1894 | United Kingdom | 273/244 |
| 19634 | of 1899 | United Kingdom | 273/258 |

*Primary Examiner*—Richard C. Pinkham
*Assistant Examiner*—Scott L. Brown
*Attorney, Agent, or Firm*—Hirons, Rogers & Scott

[57] ABSTRACT

A sailboat racing game comprises a game board having a grid pattern of interfitting connection means, and sets of sailboat representing playing pieces with complementary interfitting connection means. Each playing piece has a pair of interfitting connection means, e.g., pegs, to be interfitted in complementary holes of the grid pattern of the baseboard. The pegs of each playing piece are separated from one another by a characteristic distance, which determines the direction of travel of that playing piece across the board by interfit of the pair of pegs in the grid. Indicia are provided on the playing pieces, to indicate this direction of travel. A player determines his course of sail by selection of the appropriate playing piece. The separation of the pegs also determines the speed at which a given playing piece travels, since a playing piece moves a distance across the grid corresponding to its peg separation on each move. Provision is also made for simulating wind shadows caused by the boat representing playing pieces, and for simulating the effects of limited wind shifts.

6 Claims, 4 Drawing Figures

SAILBOAT RACING GAME

FIELD OF THE INVENTION

This invention relates to instructional and amusement games and apparatus for playing such games. More particularly, it relates to an instructional and amusement game which simulates sailboat racing.

BACKGROUND OF THE INVENTION

The sport of sailboat racing is one which requires considerable amounts of skill and experience in order to achieve competence and to permit full enjoyment thereof. Determination of correct tactics, selection of the most advantageous courses to be sailed, etc., essentially requires the experience gained in practice of yacht or sailboat racing. To obtain the necessary knowledge solely by experience of sailing conditions is time consuming, and exposes the novice on occasion to potentially hazardous conditions. There is a need for a teaching means whereby some at least of the fundamentals of sailboat racing and its tactics can be taught, on shore, in a pleasant and enjoyable manner.

DESCRIPTION OF THE PRIOR ART

A variety of amusement and game devices have been proposed in the past, intended to represent or simulate nautical sports or events of one type or another. Various examples are to be found in U.S. Pat. Nos. 568,808; 1,373,679; 1,533,540; 1,616,218; 1,726,444; 1,848,880; 3,308,577; 3,471,151; Canadian Pat. No. 495,506 and British Pat. No. 19634 of 1899.

U.S. Pat. No. 3,871,656 Selness, issued Mar. 18, 1975, discloses a sailboat racing game in which a transparent overlay having inscribed thereon a plurality of predetermined sailing courses is used. A small, sailboat-representing playing piece is used, to move along the predetermined courses. In one area of the playing surface of Selness, a square grid pattern is marked, to represent a windward leg of a triangular course. Whilst the wind direction may vary with respect to the angle of the grid, the port and starboard tacks are always along the grid lines, and hence at right angles to each other. A selection of five different fixed downwind leg courses are provided, with interconnections between them, for the boats to traverse at the selection of the player. Similar alternate reaching leg courses are provided. Boat representing playing pieces are moved along a fixed course selected by the player, according to the chance drawing of cards. Starting positions are also drawn by chance drawing of cards. Thus, in many respects, the game does not accurately simulate an actual sailboat race, and the players have freedoms of movement of their playing pieces which are much restricted as compared with those encountered in practice.

SUMMARY OF THE INVENTION

It is an object of the present invention to provide a new and improved sailboat racing game.

It is a further object to provide a sailboat racing game which more accurately simulates conditions encountered in sailboat racing in practice, so as to serve as a teaching aid.

Briefly, the sailboat racing game in accordance with the present invention comprises a game board on to which can be releasably attached, by means of interfitting connections, a variety of sailboat representing playing pieces. The game board has a uniform grid pattern thereon over substantially the whole of its race course representing area. Boat representing playing pieces are provided which have co-operating formations thereon, for reception on the grid pattern, at predetermined angles to the grid as determined by the spacing between the formations, and indicia, provided on the boat. Each player has a set of such playing pieces from amongst which he can select a piece which represents his chosen direction of sail, relative to the wind direction, and his consequent speed of travel. By means of this arrangement, a player can chart a course of sailing over the playing surface which is effectively unlimited as to direction, so as to simulate more closely sailboat racing on a substantially open stretch of water. The game board may include an indicator of wind direction, which may be movable under certain circumstances to indicate a wind shift. Buoy-representing markers may also be releasably attached to the board as playing pieces, to set out a racing course.

Thus according to the present invention, there is provided a sailboat racing game apparatus comprising:

a base board having thereon, intersecting rows of first interfitting connecting means, each of said interfitting connecting means being spaced from its adjacent neighbor, by a predetermined unit of distance so as to define a grid pattern on said base board;

at least two similar sets of sailboat-representing playing pieces, each of said playing pieces having a bow end and a stern end, and being provided with a pair of spaced apart second interfitting connecting means for releasably interconnecting with the first interfitting connecting means on said base board;

each playing piece of a set having a predetermined spacing between its pair of second interfitting connecting means, thereby permitting registry of the playing piece on the base board with its connecting means interfitting with the first connecting means on the base board, at a predetermined angle to the direction of the rows of said first interfitting connecting means;

and each playing piece bearing indicia denoting the angle of registry of said playing piece with the direction of the rows of interfitting connecting means in the base board when the second interfitting connecting means of said playing piece are correctly received in said first interfitting connecting means of the base board.

BRIEF REFERENCE TO THE DRAWINGS

The invention will be further described, by way of example, with reference to the accompanying drawings, wherein.

In the drawings, like reference numerals indicate like parts.

DESCRIPTION OF THE PREFERRED EMBODIMENTS

Figure 1:
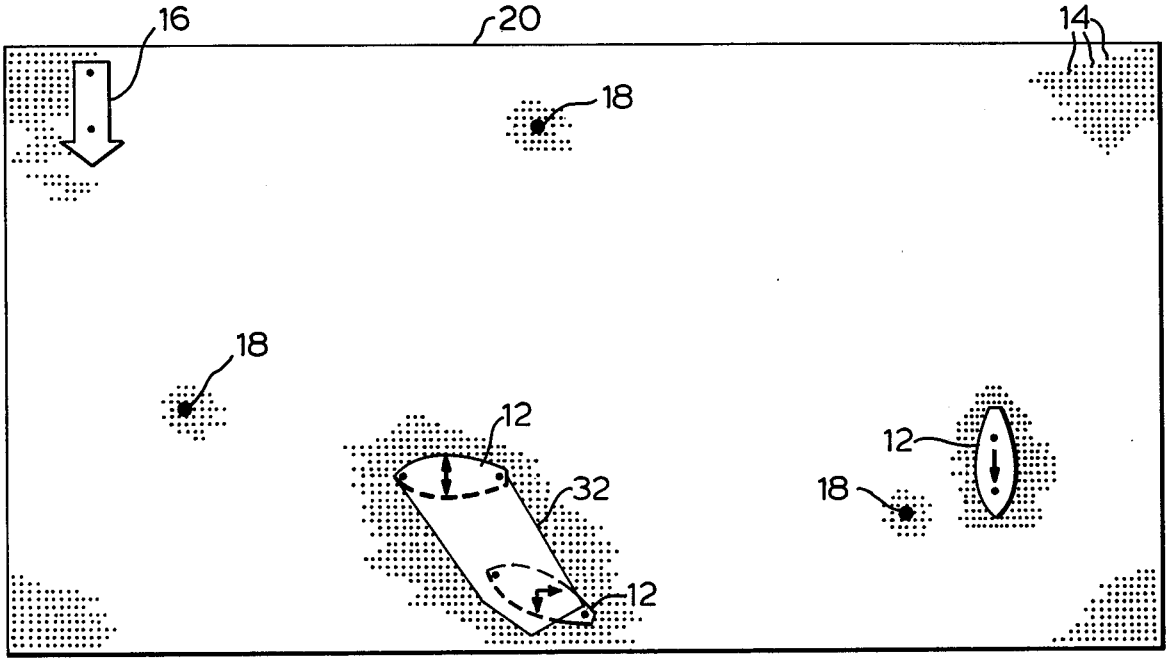
FIG. 1 is a plan view of the sailboat racing game apparatus in accordance with the present invention.

The base board of the apparatus is conveniently of the nature of a perforated board, with the first connecting means comprising small diameter holes, arranged in mutually perpendicular rows to form a square grid pattern. Then, each boat representing playing piece has a pair of downwardly extending pegs as the second connecting means, sized so as to be a snug fit within the holes of the base board.

Preferably each set of boat representing playing pieces comprises several different pieces, e.g., 6–16, each of which has a predetermined spacing between its pair of protruding pegs, and each of which can only correctly be fitted onto the base board playing surface at a specific angle or pair of angles to the direction of the grid, indiciated by indicia on the piece. Each piece bears on a surface an indicia or pair of indicia which line up parallel with the base board when the boat is positioned at the correct angles to the grid. Thus, in play, the player chooses from his set of playing pieces the correct piece which allows him to "sail" in the desired direction across the board, and at any given time has only one piece selected from his set of pieces in play on the board. To change his course, i.e., his direction of travel, the player replaces his playing piece with another from his set which may travel in his newly chosen direction. In playing the game, a single move involves the movement of a playing piece across the grid, in its predetermined direction, a distance determined by the spacing of the pegs of the respective playing piece. Thus, on a given playing piece, the peg spacings determine the speed at which the boat travels, as well as its direction of travel relative to the grid. Since the wind direction is fixed in relationship to the grid direction in playing the game, the peg spacing on a given piece is representative of a combination of factors—the direction relative to the wind in which that piece may move, and its relative speed of movement, consequent upon its direction of movement relative to the wind direction.

There may be provided a separate playing piece of a set for each given direction of movement or sail relative to the wind direction, in which case the playing pieces bear a pair of direction indicating indicia disposed equiangularly with respect to the longitudinal axis of the piece. In such case, each set comprises suitably 12–16 playing pieces. Since however in practice different combinations of sail direction relative to the wind and consequent speed of travel may give rise to identical peg spacings, some playing pieces may "double up, " and be usable for travel in a plurality of directions. In such case, the combination playing piece bears two or more pairs of indicia, clearly marked, indicating its two or more sailing direction variations. Then, the total number of playing pieces in a set may comprise about 6–12.

There is also included, in the preferred embodiment, a wind direction indicator which signifies the wind direction relative to the base board grid, and in relationship to which the playing pieces are moved. Preferably the wind direction is parallel to one axis of the grid. Thus, each playing piece of a set is arranged to "sail" at a predetermined angle relative to the wind direction.

Suitably a directional indicia is provided, for attachment to the board, indicating the wind direction. As an additional variable factor in the playing of the game, the preselected wind direction may shift, to a new predetermined angle, either side of the original wind direction, and thereby affect the boat speeds, as described below in connection with the specific embodiment.

In a single move in the game, a player moves his playing piece forwardly in a direction corresponding to the spacing between the pair of pegs on the board, i.e., the rear peg is moved to enter the hole of the grid vacated by the front peg, and the front peg is moved correspondingly forward, maintaining the correct direction relative to the grid as established by the indicia and the peg spacings. The greater the spacings between the pegs, the faster the piece travels. Thus, playing pieces designed to move in directions of optimum wind direction have large peg spacings, and vice versa.

The preferred embodiment of the invention also includes a wind shadow simulation, associated with each playing piece. In sailboat racing, it is a recognized tactic to attempt to shield an opponent's boat from the wind by interposing one's own boat between the prevailing wind and the opponent's boat, thereby enveloping the opponent's boat in the wind's shadow created by one's own boat. In the game apparatus according to the invention, each boat representing playing piece preferably has a wind shadow simulation attachment, adapted for releasable attachment to the piece on the playing board, to extend over a predetermined area of the playing surface downwind of the piece. The areal extent of the wind shadow depends upon the sailing direction of the boat to which it is attached, relative to the wind. A tactic which can be employed in playing the game is for a player to manoeuver his playing piece such that the wind shadow for that piece will envelop an opponent's playing piece, to slow down the rate of his opponent's progress.

DESCRIPTION OF THE PREFERRED, SPECIFIC EMBODIMENTS

The sailboat racing game apparatus, as best be seen in FIG. 1, comprises a game board 20 to which are releasably attached sailboat representing playing pieces 12, which according to the game can be moved around the board by certain moves, to complete a designated racing course.

The board 20 of the game is a generally flat perforated board, resembling a pegboard, and having a plurality of small diameter holes 14 arranged in a mutually perpendicular intersecting pattern, each of said holes 14 being spaced from its adjacent neighbor, in both perpendicular directions, by a predetermined unit of distance, to define a square grid pattern. In the specific embodiment shown, the distance between each neighboring hole 14 center to center is about 6 cm. Each hole 14 is approximately 2 mm. in diameter and about 2 mm. deep. The board 20 is representative of a body of water for the sailboat representing playing pieces 12. The board 14 may conveniently be arranged in folding sections, for ease of storage, since it is desirable that it be of large area, for best simulation.

Indicative of a prevailing wind direction for playing the game is an arrow 16 in the upper left hand corner of the board 20. Arrow 16 has on its underside one or several peg protrusions, not shown, for attachment to the board 10. As shown in FIG. 1, the arrow 16 is pointing in a vertical, downward direction, parallel to the vertical rows of holes 12.

The board 20 further comprises buoy-representing markers 18 which are positioned as desired on board 20, so as to provide points of reference during the course of the game. The markers 18 can be small flags or spherical, buoy-representing objects which have on their respective undersides one or several peg protrusions, not shown, for attachment therewith to the board 10. The markers 18 indicate the triangular race course, e.g., an Olympic course, and the players must move their set of playing pieces around the markers 18 in predetermined order and the prescribed number of times to complete the race.

Figure 2:
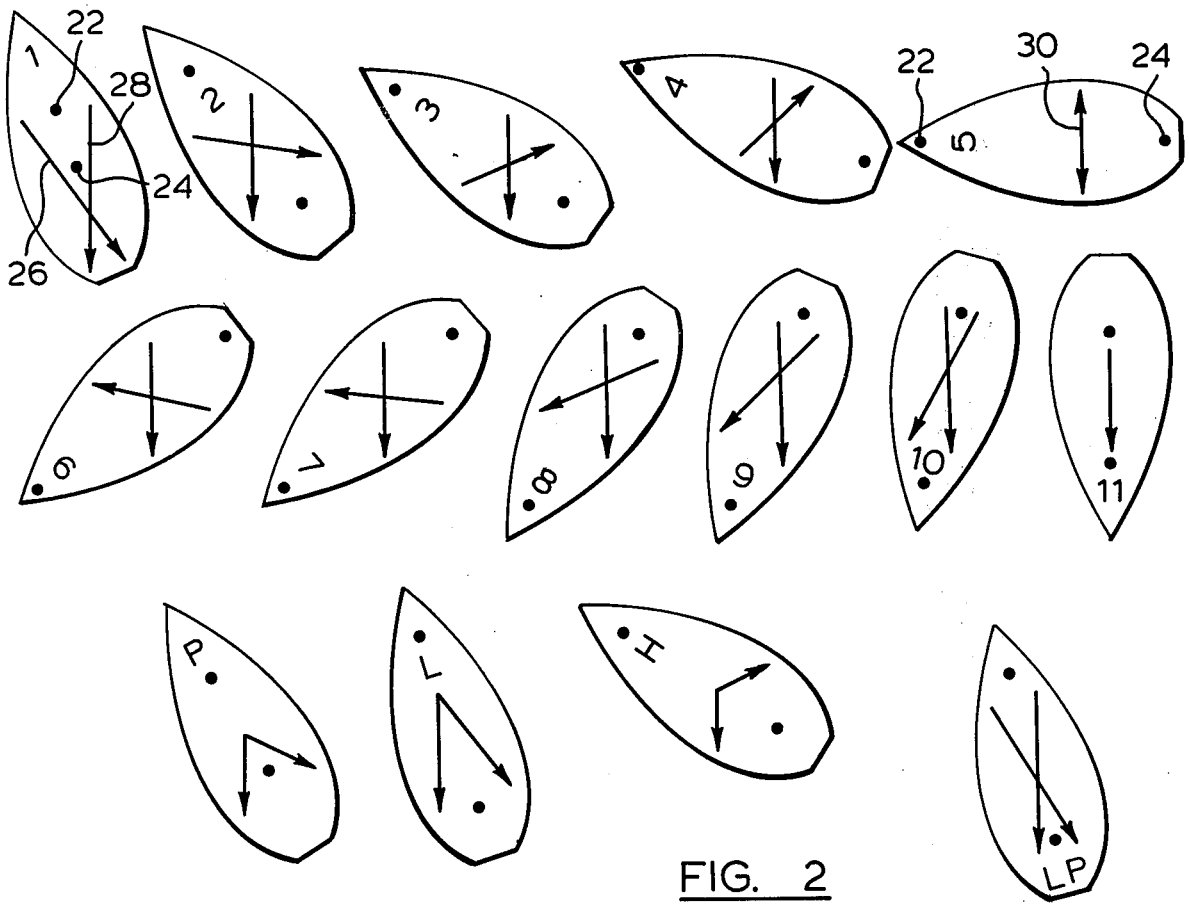
FIG. 2 is a plan view of a set of sailboat representing playing pieces forming part of the game apparatus.

Each player is provided with a set of sailboat representing playing pieces 12, one set being shown diagrammatically in plan in FIG. 2. Each playing piece 12 is formed of a flat base, shaped in plan as a conventional boat. Thus, each playing piece has a generally straight-lined stern and curvilinear starboard and port sides converging into a pointed fore or bow.

Figure 4:
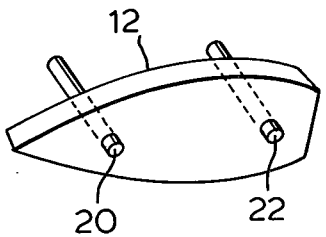
FIG. 4 is a perspective view, from underneath, of a playing piece for the game.
Figure 3:
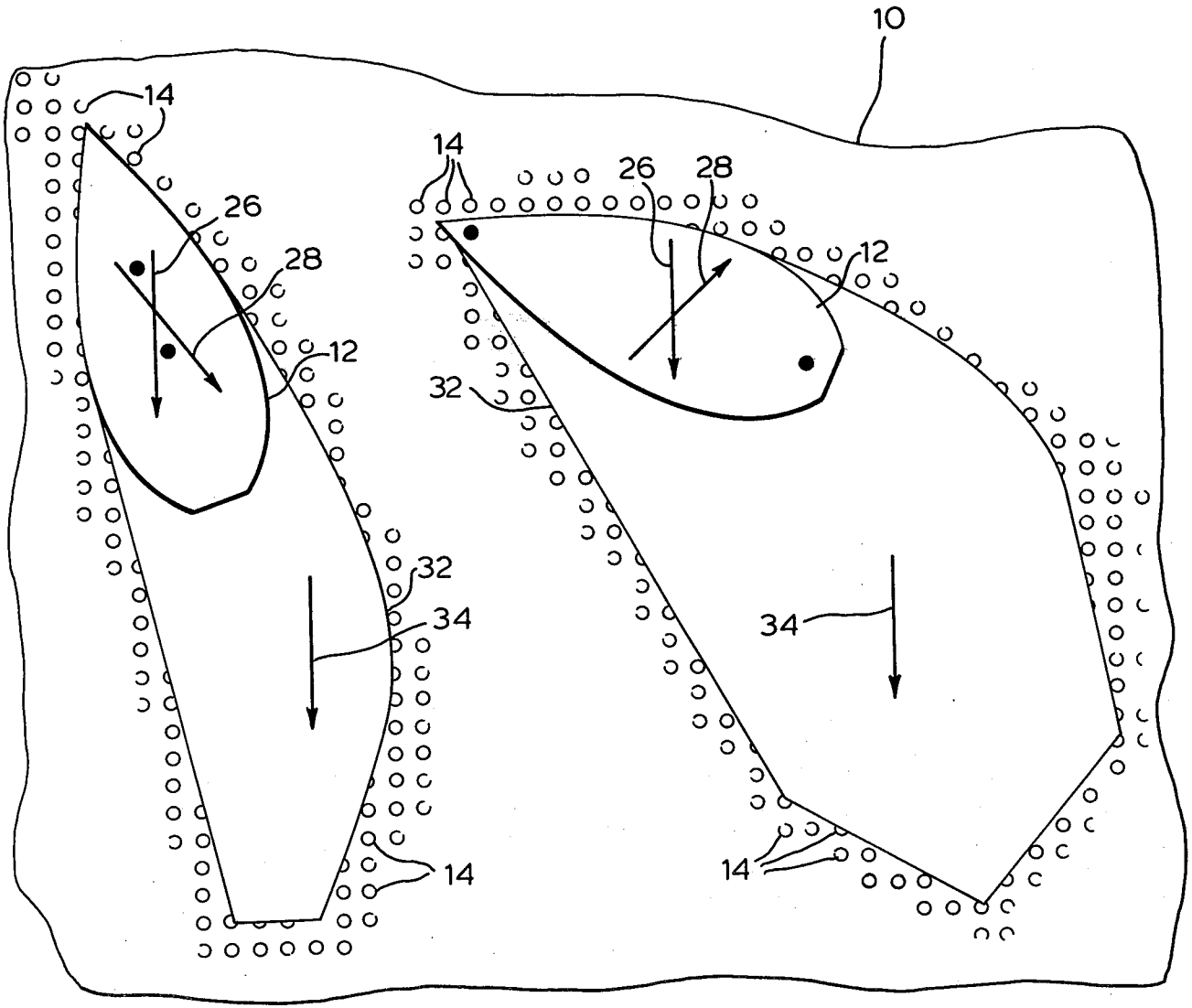
FIG. 3 is a plan view drawn to a larger scale of a portion of the game board and the game pieces, with attached wind shadow simulation means.

Each playing piece 12 has a pair of peg protrusions, namely a bow peg 22 and a stern peg 24, protruding from the underside of the playing piece 12, as can best be seen in FIG. 4, by means of which the piece can be releasably attached to the board 20, by reception of the pegs 22, 24 into the holes 14. A set of boats according to this embodiment of the present invention consists of fifteen pieces, which are numbered respectively, 1 through 11, P, L, H and L.P. They differ from one another in the spacings between their bow pegs 22 and their stern pegs 24, and in the direction of the indicia 26, 28 provided on their upper surfaces.

Taking boat piece numbered "1" as representative, its fore peg 22 and its stern peg 24 are separated from each other by a relatively short distance. This separation determines the angle at which the piece may be placed on the board 20, relative to the grid and relative to the wind direction, and thereby the directions in which it may move. There are two such possible angles, one to each side of the wind direction, and equiangularly separated therefrom. Indicia 26 aligns with the vertical rows of holes 14 on the base board 20 in one such correct placement of the piece, with its arrow pointing in the direction of the wind. Indicia 28 aligns with the vertical row of holes 14 on the base board in the other correct placement, with its arrow pointing in the direction of the wind. In either of these two directions, therefore, the piece is headed in a direction close to directly against the wind, and "tacks" in these two directions. It can therefore move only slowly in the play of the game. Thus it is provided with a small distance separating its fore peg 22 and its stern peg 24. One move in the game involves a player's moving his piece a distance on the grid of the board 20 equivalent to the spacing between its pegs. When indicia 28 is aligned with wind, the piece is on starboard tack, and when indicia 26 is aligned, the piece is on port tack.

Boat piece No. 5, in contrast, is designed to sail at right angles to the direction of the prevailing wind as indicated by its indicia 30, and consequently has a larger spacing between its fore peg 22 and its stern peg 24. In playing the game, this piece moves relatively fast. All of the boat pieces numbered 1 through 11 have their own characteristic spacing between their pegs 22, 24 to determine the speed with which they travel, and represent boat speeds, in knots. Moreover the peg spacings on the individual boat pieces determine that they can only be received in the holes 14 in the grid on the base board 20 at the correct angles for their direction of movement, where the respective indicia are aligned with the vertical rows of holes of the grid, with arrows pointing in the direction of the prevailing wind.

Boat piece No. 2 has indicia and peg spacings allowing it to move at an angle of about 40° to windward, which gives approximately the optimum speed when sailing to windward in practice. The pegs on boat piece No. 2 are thus quite widely separated. Boat piece No. 11 moves directly downwind so that it has only a single indicia arrow 30, in other words its pair of indicia arrows coincide.

In addition to the number of boats per set, there are included three boats referred to as the lifter (L), header (H) and pinching (P) boats. "Pinching" is a sailing term that indicates that a boat is sailing so close into the wind that the sail begins to loose its pulling power so that the boat speed is reduced. A pinching boat P is provided among the set, which a player can select for sailing in a direction very close to the wind. "Lifting" is a term referring to the ability of a boat to sail on a more direct course towards a mark which is directly upwind, and occurs when the wind shifts direction more towards the side of the boat. "Heading" is a term referring to the opposite condition from a lifted boat—the wind shifts more towards the front of the boat, thereby forcing the boat to change direction away from the wind. To take account of such occurrences in the game according to the preferred embodiment of the invention, there are provided lifter, header, and lifter-pinching boat representing pieces among each set of playing pieces.

Relative speeds and sailing directions of the various boat pieces are given in Table I.

TABLE I

| Boat No: | Relative Co-ordinates of Fore Peg To Stern Peg | Approximate Angle of Movement Off wind Direction | Relative Speed (Knots) i.e. Relative Distance Between Pegs |
|---|---|---|---|
| 1 | 1 side, 3 up | 18° | 2.0 |
| 2 | 6 side, 7 up | 40° | 5.85 |
| 3 | 9 side, 6 up | 56° | 6.87 |
| 4 | 12 side, 5 up | 67° | 8.24 |
| 5 | 13 side | 90° | 8.25 |
| 6 | 12 side, 5 down | 113° | 8.24 |
| 7 | 9 side, 8 down | 132° | 7.67 |
| 8 | 6 side, 9 down | 146° | 6.90 |
| 9 | 4 side, 10 down | 158° | 6.87 |
| 10 | 2 side, 9 down | 167° | 5.89 |
| 11 | 7 down | 180° | 4.97 |
| Pinching | 3 side, 5 up | 30° | 3.7 |
| Header | 8 side, 5 up | 58° | 5.9 |
| Lifter | 3 side, 9 up | 19° | 5.9 |
| Lifter-Pinching | 1 side, 6 up | 9° | 3.85 |

Thus in deciding his sailing course to complete the race, a player may choose among his various boat pieces, having regard to the speed at which a boat piece may move, and having regard to the direction in which it may sail. The tactics to be adopted and the criteria by which the choices are made resemble those arising in practice in sailboat racing. For example, for windward sailing, boats 1–4 can be used, so as to tack at various angles to windward, the boat being moved on starboard tack or port tack, at equal angles to the wind direction.

For each boat of a set, there is provided a flat transparent overlay sheet 32, to represent a wind shadow caused by the boat. Each wind shadow is adapted to be placed on a respective boat representing piece, and is provided with apertures which fit over the upper ends of pegs 22, 24 protruding from the upper surface of the respective boat. Each such wind shadow representation is labelled as to the boat to which it belongs, and has appropriate spacings between its attachment apertures to correspond with the peg spacings on the respective boat to which it fits. Indicia are provided on the wind shadow, in the form of an arrow 34 which must be lined up with the rows of holes 14 of the grid on the base board 20, corresponding with the wind direction, for correct placement of the wind shadow in play. Since each boat representing piece 12 is capable of movement in two different directions, either side of the wind direction, its respective wind shadow sheet must be mounted on the boat the correct way up so that its indicia arrow 34 coincides with the wind direction. The wind shadows 32 are arranged to extend downwind from their respective boats. When they cover an area of the board 20 into which an opponent's boat extends, the opponent's boat is said to be wind shadowed, and receives a penalty which slows down its rate of progress. The size and shape of the wind shadows is arbitrarily arranged so as roughly to correspond with the size and shape of the wind shadow which would likely be encountered in practice, from a sailboat sailing at the given angle with respect to the wind direction. The size of penalty to be extracted is set by the rules of the game prior to play, and is designed so as approximately to correspond to that encountered in practice when one sailboat shields another from the wind.

Other variables can be introduced into the method of play of the game, such as penalties or advantages for "better sail trim differential." The entitlement of a player to such an advantage may be determined by the roll of a die or the draw of a card or other similar chance method. When a player is entitled to a "better sail trim differential," he may enhance each move while the differential is in effect, by a predetermined amount established by agreement before commencement of the game, suitably by reference to a chart which gives the details with respect to each boat of a player's set.

By similar chance means, a "wind shift" may come into effect during play of the game. In this embodiment of the game, the chance may indicate that the wind has shifted, in either direction, by a given angle, namely about 19°. Any boat-representing piece which is on a windward leg at the time the shift comes into effect is affected by the wind shift, and may be "headed" or "lifted" according to the direction of the wind shift and the tack (port or starboard) which the boat is on when the wind shift comes into effect. If the direction of wind shift is such that the starboard tack is lifted, the player whose piece is on a starboard, lifted tack at the time of coming into effect of the wind shift may use any of boats 1 through 11, or his lifter boat (L) or his lifter-pinching boat (LP), thereby giving him an advantage. Conversely, a player whose boat is on a headed tack when the wind shift comes into effect may not use boats 2,3 or 4, or the lifter or lifter-pinching boats, thus putting him at a disadvantage in accordance with that encountered in actual sailing conditions. He may choose to change direction to a "Lifted" tack, to take advantage of the wind shift.

In the play of the game, a starting line is set near the center of the board. It will be appreciated that the game board may be a plurality of adjacent base board sections, foldable or stackable when the game is not in play, to provide a necessarily large playing surface. The course to be sailed may be set out as an Olympic course, i.e. having a windward leg directly into the wind, a directly downwind stretch, and two downwind legs at about 45° to the wind direction. All boats move at the same time except that, in tactical situations (e.g. tacking or luffing matches) each player rolls a die, and the player rolling the higher number moves first. Each player chooses a sailboat representing piece 12 from his set, and places it on the board 20 wherever he pleases. The race starts after a given number of moves for each player, e.g. 20 moves, and then the pieces must start over the start line and proceed around the markers in the prescribed order and direction for the course. Normal yacht racing rules are followed, as regards rights of way, fouling etc. At the commencement of each turn, dice are rolled to determine if a wind shift is to come into effect, or if either player is entitled to a "sail trim differential" advantage. Also, wind shadows are applied to each piece on the board to see if any of the pieces is caught by an opponent's wind shadow. If it is, the appropriate penalty is extracted. At each turn, a player may at his option replace his playing piece with another from his set, so as to alter course, or "tack" his playing piece by moving it from an angle in which one of indicia 26, 28 is aligned with the wind direction, to the angle where the other indicia is so aligned. Changes in direction of greater than 90° in a single turn are prohibited, to replicate actual sailing experiences. Sailboats cannot in practice make large, sudden changes in sailing direction. Then the player in his turn moves his chosen boat piece 12 in the chosen direction, a distance corresponding to the peg spacings on the boat, placing the stern peg in the hole on the board previously occupied by the fore peg. When a chance rolling of the dice indicates that a wind shift is in effect, the movements of the players are adjusted accordingly, as previously described. When the wind shift is away from the head-on position of a windward sailing piece, that piece is "lifted," and the player may use any of his boat pieces including his lifter boat L, and his lifter-pinching boat LP. These boat representing pieces are used to duplicate the effect in practice of a 19° shift in wind direction. Conversely, when a boat piece is "headed" by a wind shift, the choice of boat pieces which can be played is restricted. The lifter boat L, header boat H and lifter-pinching boat LP of each set are only used when a wind shift is in effect.

The pinching boat P of a player's set can be used in the game at any time when no wind shift is in effect. Its purpose is to allow a player to move his boat in a direction slightly closure to the wind direction then the optimum 40° tack, to enable more advantages positioning for wind shadow purposes.

The lifter-pinching boat LP is only used on a lifted tack when the wind shift is in effect.

Whilst in the embodiment shown, each set of boat representing playing pieces consists of 15 different pieces, it will be noted that the peg spacings on boats 3, 8 and 9 are the same as one another, and the peg spacings on boats 4, 5 and 6 are also the same as one another. If desired, therefore, a single piece can be used to represent boats 3, 8, 9, and a single piece can be used to represent boats 4, 5, 6, with plural sets of indicia on each. This reduces the number of boat pieces 12 in each set to 11 in total. Also, one set of wind shadow representations will serve for both sets of boat pieces 12, if desired, since these are only temporarily placed in position to measure their envelope extent at the start of each turn.

Thus in the game according to the invention, the players have freedom of movement over the whole areal extent of the playing surface, to plot their own courses around the markers in the race, as in the case of sailboat racing on an open stretch of water. There are no predetermined paths or courses to follow, nor restrictions upon sailing angles or directions, except as provided by the square grid pattern and the set of boat pieces 12 provided. Wind shift factors and wind shadow factors closely replicate the conditions encountered in actual yacht racing. The players can plot courses and adopt tactics closely resembling those to be used in practice.

Whilst a specific embodiment of the invention has been illustrated and described in detail, it is to be understood that this is by way of illustrative example only. The scope of the invention is limited only by the appended claims.

What I claim is:

1. A sailboat racing game apparatus comprising:

a base board having thereon, intersecting rows of first interfitting connecting means, each of said interfitting connecting means being spaced from its adjacent neighbor by predetermined units of distance so as to define a grid pattern on said base board;

at least two similar sets of sailboat representing playing pieces, each of said playing pieces having a bow end and a stern end, and being provided with a pair of spaced apart second interfitting connecting means for releasably inter-connecting with the first interfitting connecting means on said base boards;

each playing piece of a set having predetermined spacing between its pair of second interfitting connecting means, thereby permitting registry of the playing piece on the base board with its connecting means interfitting with the first connecting means on the base board, at a predetermined angle to the directions of the rows of said first interfitting connecting means;

each playing piece bearing indicia denoting the angle of registry of said playing piece with the direction of the rows of interfitting connecting means in the base board when the second interfitting connecting means of said playing piece are correctly received in said first interfitting connecting means of the base board;

and including a wind shadow designating means adapted to be releasably mounted on the upper surface of a playing piece of a said set.

2. The apparatus according to claim 1, wherein the first interfitting connecting means of the base board are small diameter holes, the said holes being arranged in mutually perpendicular rows to define a square grid pattern and the second interfitting connecting means of the playing pieces are protrusions adapted to be received as snug fits in said holes, and further including a wind direction indicator adapted to be removably mounted on the base board, with indicia thereon indicating a wind direction parallel to one of the rows of holes on the base board.

3. The apparatus of claim 2 wherein each set of sailboat representing playing pieces comprises at least six such pieces each having a bow protrusion and a stern protrusion projecting from its lower surface for reception in the small diameter holes on the base board, playing pieces of the set being adapted to be disposed on the base board at two predetermined directions relative to the direction of the grid, said two directions being equiangularly spaced on either side of the wind direction.

4. The apparatus of claim 3, including at least one set of said wind shadow representing means, said set comprising a respective wind shadow indicating means for each of the boat representing playing pieces of the set, and said wind shadow representing means having predetermined areal extends and shapes differing from one another.

5. The apparatus of claim 4, wherein each said wind shadow representing means has a pair of apertures therein adapted to releasably fit over upper extremities of said protrusions on the respective playing piece.

6. The apparatus of claim 5, wherein each said wind shadow representing means has indicia thereon for alignment with one direction of the grid.

* * * * *